US006105175A

United States Patent [19]

Conti et al.

[11] Patent Number: 6,105,175

[45] Date of Patent: Aug. 22, 2000

[54] SYSTEM FOR KEEPING STOCKING OR TIGHTS IN PLACE BY RESTING THEM ON THE HIPS AND THE TIGHTS MANUFACTURED ACCORDINGLY

[76] Inventors: Giuseppe Conti, Via Maragliano n. 137 I-50144, Firenze; Maria Assunta Bruscoli, Via Imprunetana per Pozzonatico n. 170 I-50023, Impruneta, both of Italy

[21] Appl. No.: 09/269,528

[22] PCT Filed: Oct. 24, 1997

[86] PCT No.: PCT/IT97/00263

§ 371 Date: Mar. 29, 1999

§ 102(e) Date: Mar. 29, 1999

[87] PCT Pub. No.: WO98/19566

PCT Pub. Date: May 14, 1998

[30] Foreign Application Priority Data

Nov. 5, 1996 [IT] Italy ..... PI96U0035

[51] Int. Cl.[7] ..... A41B 9/00

[52] U.S. Cl. ..... 2/409; 2/1; 450/155; 450/115

[58] Field of Search ..... 2/409, 1, 239; 450/155, 115; 66/177, 178 R, 189, 175, 171–174, 176

[56] References Cited

U.S. PATENT DOCUMENTS

| | | | |
|---|---|---|---|
| 3,487,473 | 1/1970 | Janhsen . | |
| 3,547,128 | 12/1970 | Keltner . | |
| 4,019,208 | 4/1977 | Walser, Jr. . | |
| 4,400,832 | 8/1983 | Kinder | 2/409 X |
| 5,014,364 | 5/1991 | Orr . | |

FOREIGN PATENT DOCUMENTS

| | | |
|---|---|---|
| 1217220 | 12/1970 | United Kingdom . |

*Primary Examiner*—Gloria M. Hale
*Attorney, Agent, or Firm*—Ladas & Parry

[57] ABSTRACT

The invention regards stockings or tights which are kept in place by a system resting on the hips and, therefore, do not oblige the wearer to suffer either pressure round the waist, caused by common elastic bands, nor a tight clasping around the thigh. The system resting on the hips (6, 7) allows an equal distribution of the force necessary to keep the stockings in place, which can therefore be worn for a long time since the wearer does not feel any discomfort on the abdomen or the thighs.

8 Claims, 2 Drawing Sheets

SYSTEM FOR KEEPING STOCKING OR TIGHTS IN PLACE BY RESTING THEM ON THE HIPS AND THE TIGHTS MANUFACTURED ACCORDINGLY

TECHNICAL FIELD

This invention regards the technical field of hosiery and the manufacture of stockings and tights in general. In particular, it concerns a new product consisting of stockings or tights which are kept in place by resting on the wearer's hips.

BACKGROUND ART

Experts in this field know stockings and tights, normally worn by women and consisting of two moulds which are slipped on the legs and are kept in place in different ways.

The known systems for holding up stockings, e.g. the so-called "self-supporting" stockings, consist of elastic bands which press on the upper part of the thigh. These systems have the drawback of being uncomfortable to wear and of pressing this part of the leg too tightly, sometimes also affecting blood circulation.

Other systems are known, such as garters or similar, consisting of a structure resting on the thigh or round the waist and used to keep the stocking in place by hooking it up. These systems are also not very practical because they can often be seen, especially under a close-fitting dress, and they can be awkward to use.

The most widespread system to keep stockings in place is, however, that used for common tights, i.e. a kind of panty forming part of the two moulds of the legs and supplied with an elastic band around the waist, which keeps the tights in place.

However, this widespread system also has the drawback of pressing the waist too tightly and of therefore being uncomfortable to wear.

DISCLOSURE OF INVENTION

This invention principally aims at eliminating the above-mentioned drawbacks and of supplying a stocking which is comfortable to wear, does not press on any part of the body too tightly and does not require any accessories.

This target has been reached-with the invention by realising the idea of stockings or tights with the characteristics described in the seperate claims.

Other characteristics of the stockings are the object of dependent claims.

The advantages resulting from this utility model essentially consist of the fact that the stockings are self-supporting and can be worn without the use of elastic bands which press on the waist or the thigh, and without any accessories; that these stockings can be manufactured as one unit comprising the two moulds of the legs integrated in the supporting pants, and that the same supporting system can be used when the two moulds are separate; that it looks attractive and does not feel awkward for the person wearing it; that the type with the two separate moulds for the legs is easy and comfortable to wear as it allows the wearer to keep the stockings on and wear a normal pair of pants which can be put on and taken off without taking off the stockings; that it keeps the stockings perfectly in place and that the supporting force is proportionally distributed so that the wearer does not feel any pressure on the skin.

These and other advantages and features of this model can be easily understood by every expert in this field by reading the following description and looking at the drawings enclosed.

Reduced to its essential structure and with reference to the figures or the drawings enclosed, a stocking resting on the hips, and which has a supporting system according to the invention, comprises:

means to support the stocking or tights with one part of the stocking resting on one or both hips, specifically on the top of the hipbone;

means allowing a proportional distribution of the force necessary to keep the stockings in place, with the same stockings forming a "V" in the abdominal region once they are put on;

Expediently, the stockings resting on the hips can be manufactured in the form of tights supplied with pants which do not have the usual form with an elastic band around the waist, typical of currently existing tights, but have a "v" shape (3) so that they do not press on the waist or the abdomen and exert a proportional force on both hips.

Another advantage lies in the fact that the V-shaped part of the stockings is thickened with elastic material (3) generating various tensions thus eliminating the necessity of a common elastic band.

In addition, the said V-shaped part can be bordered by a thicker zone (2) or may be trimmed with lace or other trimmings.

Expediently, the stockings in question can be manufactured by constructing the two moulds of the stockings so that each single stocking forms an elongated, obliquely cut cylinder; once the two stockings have been crossed and sewed together (FIG. 1), a thicker front zone (2) is obtained, thanks to the crossing of the two moulds of the legs, which is closed at the bottom and open at the top so that the wearer can adjust the rest on the hips according to her body structure.

Another advantage of the tights consists in the fact that they can be supplied with an insert of cotton or other suitable material in the vaginal region, which may be attached or detachable so that it can be replaced.

Expediently, as part of the manufacture there will be an insert of cotton or other suitable material, with the same shape as the actual crossing (2) or designed shapes around the back and the front of the stocking, and, however, so that it can be attached or removed with self-adhesive systems or similar according to specific requirements.

The system of resting on the hips can expediently be realized by manufacturing both, tights (1) with the above described features and two single stockings (4, 5), each of them resting on one hip (6, 7), which are pulled onto the legs separately and, once they are put on, form a crossing over the abdomen, which corresponds to the "V" zone of the tights and has the same effects and characteristics.

Another advantage lies in the fact that the two separate stockings (4, 5) can be made of different shapes, i.e. So that they cover the groin or keep it free (9) according to specific requirements. In the latter form, the stockings are particularly easy to wear as the pants can be put on after the stockings have been put on and can be taken off without having to lower the stockings each time.

Expediently, the stockings in question can be manufactured in various sizes and yarns according to the specific manufacture and market requirements.

The rest on the hips has been expediently designed so that both ends of the stockings rest on the hipbone thus guaranteeing that the stockings are perfectly kept in place. Another advantage consists of the fact that the back and the front of the stockings have the same form.

In practice, the manufacturing details may, however, vary as regards shape, size, position of elements, and type of materials used, but still remain within the range of the idea proposed as a solution and, consequently, within the limits of the protection granted by this patent for a utility model.

Table 2/2 shows a schematic drawing of tights according to the system in question, composed of two separate moulds which are put on one after the other.

Figure 3:
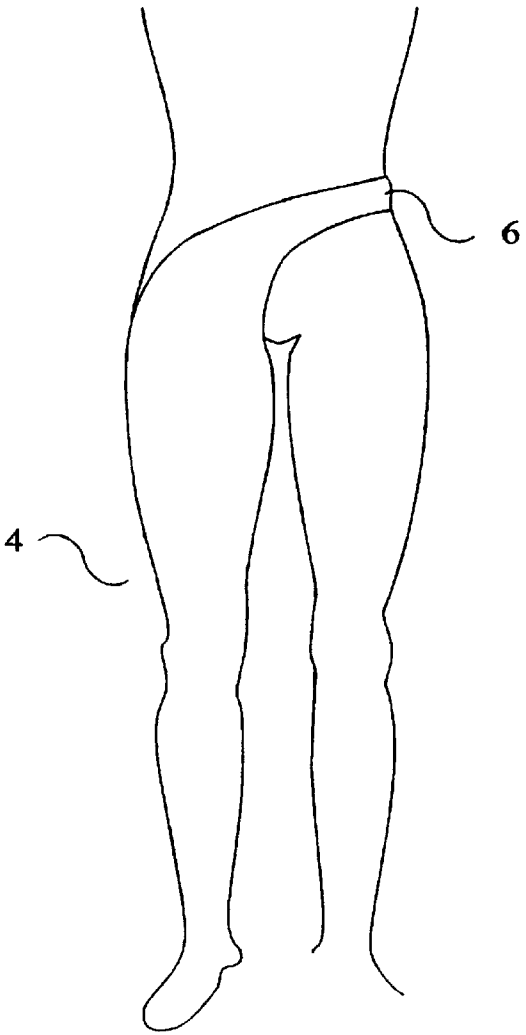

FIG. 3 shows the stocking (4) worn on the right leg, supplied with an extension resting on the left hip (6).

Figure 4:
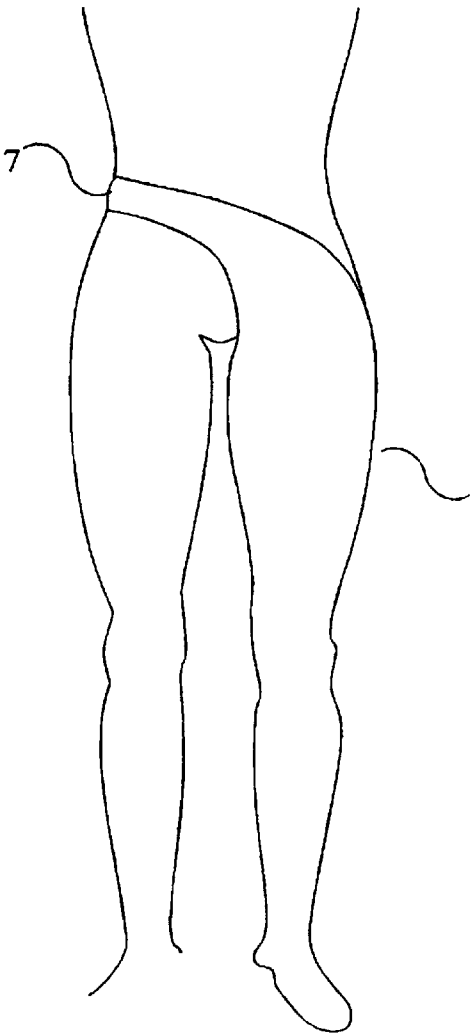

FIG. 4 shows the stocking (5) worn on the left leg, supplied with an extension resting on the right hip (7).

Figure 1:
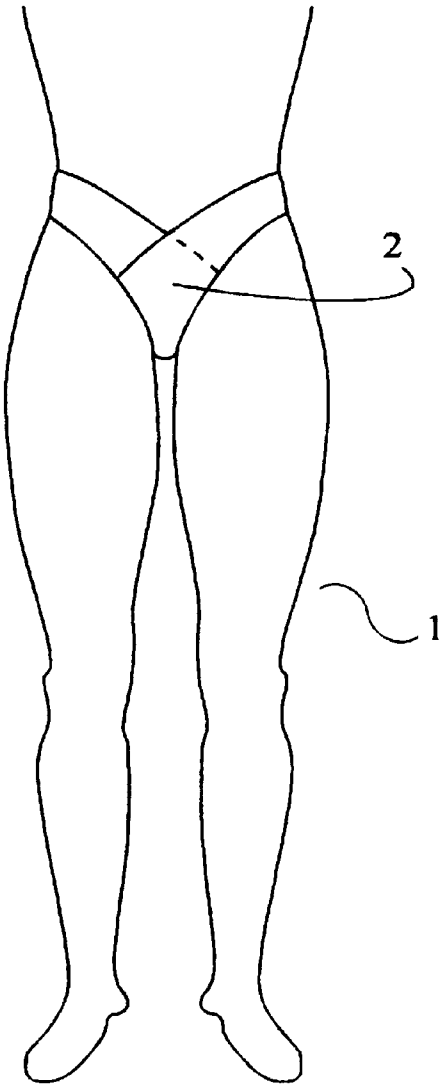
FIG. 1, table 1/2 shows a schematic drawing of a stocking (1) supplied with a thicker zone (2) formed by the crossing of the slightly V-shaped two moulds, in order to obtain a distribution of the force by keeping the stocking on the hips and not on the waist.
Figure 2:
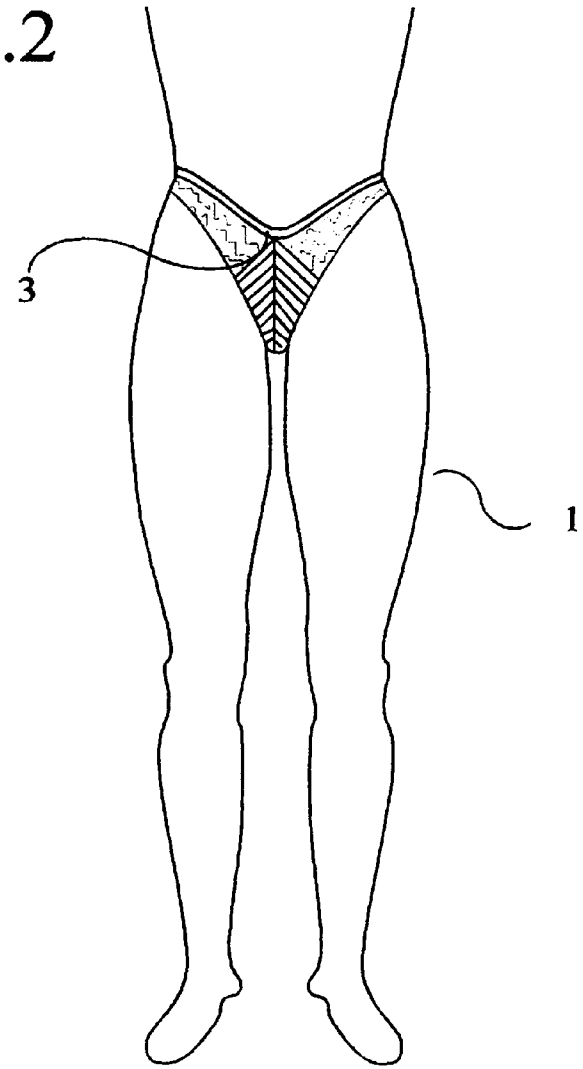
FIG. 2 is a scheme of another model of stockings using the system in question, in which the stockings (1) rest on the hips thanks to a thicker part of different tensions (3) forming a "V" at the top of the tights.
Figure 5:
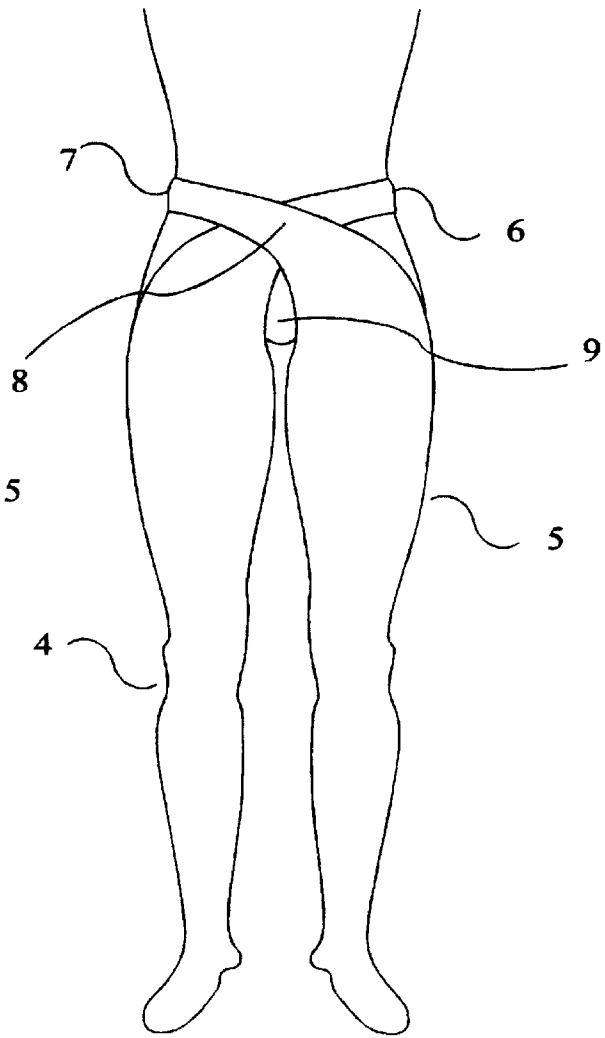

Finally, FIG. 5 shows the result obtained once both stockings (4, 5) are put on and rest on the left (6) and right (7) hip respectively, forming a slight crossing (8) over the abdominal region and leaving the groin (9) free.

What is claimed is:

1. A garment comprising two hose portions (4,5) each having a foot and leg portion and a hip engaging portion (6, 7), whereby said hip engaging portions (6, 7) extend over the wearer's hip and overlap each other for a part in front and rear by forming a substantially V-shaped top edge, wherein the hip engaging portion (6, 7) of each hose portion (4, 5) consists of a diagonal, relatively narrow band which starts from an upper end of the hose portion (4, 5) and rests only on an upper part of the opposite wearer's hip substantially on the respective hipbone, each said diagonal, relatively narrow band crossing in the abdominal region without encircling the wearer's waist.

2. A garment according to claim 1, wherein the diagonal bands are separate, crossing over each other, in the crossing zone (8).

3. A garment according to claim 1, wherein the diagonal bands are joined together in the crossing zone (8).

4. A garment according to claim 1, wherein a connecting portion between each hose portion (4, 5) and the respective diagonal band is disposed so that the bands cover the wearer's crotch.

5. A garment according to claim 1, wherein the connecting portion between each hose portion (4, 5) and the respective diagonal band is disposed so that the bands leave the wearer's crotch uncovered.

6. A garment according to claim 1, wherein each hose portion (4, 5) extends upwards as far as to join the diagonal band of the other hose portion (5, 4) and to cover a side part of the respective hip.

7. A garment according to claim 1, wherein an upper extremity of each hose portion (4, 5) does not reach the diagonal band of the other hose portion (5, 4) and leaves free a side part of the respective hip.

8. Tights (1), an upper edge of which is V-shaped and rests on a wearer's hips, wherein a pant portion of the tights is provided with a V-shaped zone (3), said tights being made of an elastic material and said V-shaped zone being made of thicker elastic material compared to a remaining portion of the tights.

* * * * *